US011951364B2

(12) United States Patent
Shimahara

(10) Patent No.: US 11,951,364 B2
(45) Date of Patent: Apr. 9, 2024

(54) GOLF CLUB HEAD

(71) Applicant: Sumitomo Rubber Industries, Ltd., Hyogo (JP)

(72) Inventor: Yuki Shimahara, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/740,889

(22) Filed: May 10, 2022

(65) Prior Publication Data

US 2022/0387862 A1 Dec. 8, 2022

(30) Foreign Application Priority Data

Jun. 7, 2021 (JP) ..... 2021-095327

(51) Int. Cl.
*A63B 53/04* (2015.01)

(52) U.S. Cl.
CPC ..... *A63B 53/047* (2013.01); *A63B 53/0408* (2020.08); *A63B 53/0433* (2020.08)

(58) Field of Classification Search
CPC ..... A63B 53/047; A63B 53/0433; A63B 53/0408; A63B 53/0475; A63B 2053/0479; A63B 2053/0483; A63B 53/0458; A63B 53/0462
USPC ..... 473/324–350, 287–292; D21/747–749
See application file for complete search history.

(56) References Cited

U.S. PATENT DOCUMENTS 1,320,163 A * 10/1919 Maurice ..... A63B 53/047 473/335
2,087,685 A * 7/1937 Hackney ..... A63B 53/0466 D21/747
D164,596 S * 9/1951 Penna ..... 473/324
3,059,926 A * 10/1962 Johnstone ..... A63B 53/047 473/291
3,419,275 A * 12/1968 Winkleman ..... A63B 53/0487 473/335
3,814,437 A * 6/1974 Winquist ..... A63B 60/00 473/324
3,858,886 A * 1/1975 Cosby ..... A63B 53/04 473/350
4,858,929 A * 8/1989 Long ..... A63B 53/00 473/331
5,048,834 A * 9/1991 Gorman ..... A63B 53/047 473/350

(Continued)

FOREIGN PATENT DOCUMENTS

JP 2020-178933 A 11/2020

*Primary Examiner* — Sebastiano Passaniti
(74) *Attorney, Agent, or Firm* — Studebaker & Brackett PC

(57) ABSTRACT

An iron-type golf club head comprises a face having a striking surface, a back surface, and a face thickness defined therebetween. The back surface is provided with a cavity cavity-forming portion dented toward the striking surface. The cavity cavity-forming portion is provided with a protuberance in which the face thickness is partially increased, and which extends in the top-bottom direction of the head. In the cross section of the face perpendicular to the striking surface and parallel to the toe-heel direction, the protuberance has: a ridge at which the face thickness is largest in the protuberance; and a pair of inclined surfaces extending from the ridge toward a toe side and heel side of the cavity cavity-forming portion while decreasing the face thickness.

13 Claims, 14 Drawing Sheets

(56) References Cited

U.S. PATENT DOCUMENTS 5,074,563 A * 12/1991 Gorman ..... A63B 53/047 473/350
D328,322 S * 7/1992 Antonious ..... D21/749
5,290,032 A * 3/1994 Fenton ..... A63B 53/047 473/332
5,328,184 A * 7/1994 Antonious ..... A63B 60/00 473/346
5,547,194 A * 8/1996 Aizawa ..... A63B 53/047 473/350
D377,381 S * 1/1997 Takahashi ..... D21/748
5,842,934 A * 12/1998 Ezaki ..... A63B 60/00 473/349
5,971,868 A * 10/1999 Kosmatka ..... A63B 69/3635 473/324
6,007,432 A * 12/1999 Kosmatka ..... A63B 60/00 473/324
6,471,603 B1 * 10/2002 Kosmatka ..... A63B 69/3635 473/324
6,896,627 B2 * 5/2005 Hou ..... A63B 60/02 473/335
7,549,934 B2 * 6/2009 Rice ..... A63B 60/00 473/345
7,578,755 B2 * 8/2009 Oyama ..... A63B 53/0466 473/345
8,272,975 B2 * 9/2012 Morin ..... A63B 60/00 473/342
8,382,609 B2 * 2/2013 Yokota ..... A63B 60/00 473/346
8,979,672 B2 * 3/2015 Samson ..... A63B 60/00 473/329
9,220,954 B2 * 12/2015 Matsunaga ..... A63B 53/0466
10,758,792 B2 * 9/2020 Shimahara ..... A63B 53/047
2001/0001774 A1 * 5/2001 Antonious ..... A63B 60/00 473/349
2002/0049094 A1 * 4/2002 Kosmatka ..... A63B 60/00 473/329
2002/0082117 A1 * 6/2002 Nishitani ..... A63B 60/00 473/345
2003/0176232 A1 * 9/2003 Hasebe ..... A63B 60/00 473/291
2003/0199331 A1 * 10/2003 Stites, III ..... A63B 60/02 473/290
2008/0248896 A1 * 10/2008 Hirano ..... A63B 60/02 473/346
2011/0319190 A1 * 12/2011 Wada ..... A63B 53/0466 473/349
2015/0087437 A1 * 3/2015 Song ..... A63B 53/047 473/324

* cited by examiner

GOLF CLUB HEAD

BACKGROUND OF THE INVENTION

Field of the Invention

The present disclosure relates to an iron-type golf club head.

Background Art

The following Patent Document 1 discloses a cavity back iron-type golf club in which a cavity is formed on a back face side.

Patent Document 1: Japanese Patent Application Publication No. 2020-178933

SUMMARY OF THE INVENTION

Problems to be Solved by the Invention

An iron-type golf club gives a backspin to a hit ball. In a hit ball to which sufficient backspin is given, rolling of the ball after landing (so-called run) is suppressed. In order to reduce the variation in flight distance, an iron-type golf club head capable of giving more backspin to the hit ball is desired.

However, it was found that, as compared with a so-called muscle back iron-type golf club head, a cavity back iron-type golf club head gives less backspin to the hit ball.

The cavity back iron-type golf club head has a relatively small face thickness in the portion provided with the back cavity. Therefore, when the ball hits the face, the face is bent more, and as a result, the contact time that the face and the ball are in contact, tends to become longer.

As a result of the experiments made by the inventors, it was found that the amount of backspin of the hit ball tends to decrease as the contact time becomes longer. The reason is presumed as follows.

FIG. 14 is a graph showing the relationship between the shear force acting on a ball when the ball is hit by an iron-type golf club head and elapsed time.

In FIG. 14, the vertical axis shows the shear force acting on the ball, and the horizontal axis shows the elapsed time. The ball comes into contact with the face at zero elapsed time. In FIG. 14, a positive shear force is a force in the direction giving the backspin to the ball, and a negative shear force is a force in the direction giving the ball a spin in the opposite direction to the backspin.

As a result of various experiments made by changing the rigidity of the face, it was found that when the contact time between the ball and the face becomes longer, the relative time during which the negative shear force acts on the ball tends to increase. Further, the amount of backspin of the ball is almost determined by the difference between the impulse of the positive shear force acting on the ball and the impulse of the negative shear force acting on the ball. Therefore, it is presumed that when the contact time between the ball and the face becomes longer, the impulse of the negative shear force acting on the ball becomes increased, and the amount of backspin of the ball is decreased relatively.

On the other hand, the cavity back iron-type golf club head is also desired to be further improved in hit feelings such as shot feeling and ball hit sound.

In view of the above circumstances, the present disclosure was made, and a primarily objective of the present disclosure is to provide a cavity back iron-type golf club head capable of giving more backspin to a hit ball, while providing improved hit feelings.

Means for Solving the Problems

According to the present disclosure, an iron-type golf club head comprises a face having a striking surface and a back surface opposite to the striking surface, and having a face thickness defined between the striking surface and the back surface, wherein the back surface is provided with a cavity-forming portion dented toward the striking surface, the cavity-forming portion is provided with a protuberance in which the face thickness is partially increased, the protuberance extends in a top-bottom direction of the head, and the protuberance has a ridge and a pair of inclined surfaces, wherein, in a cross section of the face orthogonal to the striking surface and parallel to a toe-heel direction of the head, the face thickness measured at the ridge is largest in the protuberance, one of the inclined surfaces extends toward a toe of the head from the ridge while decreasing the face thickness, and the other of the inclined surfaces extends toward a heel of the head from the ridge while decreasing the face thickness.

Effects of the Invention

By adopting the above structure, the iron-type golf club head according to the present disclosure can give more backspin to the hit ball while providing improved hit feelings.

DETAILED DESCRIPTION OF THE INVENTION

Figure 1:
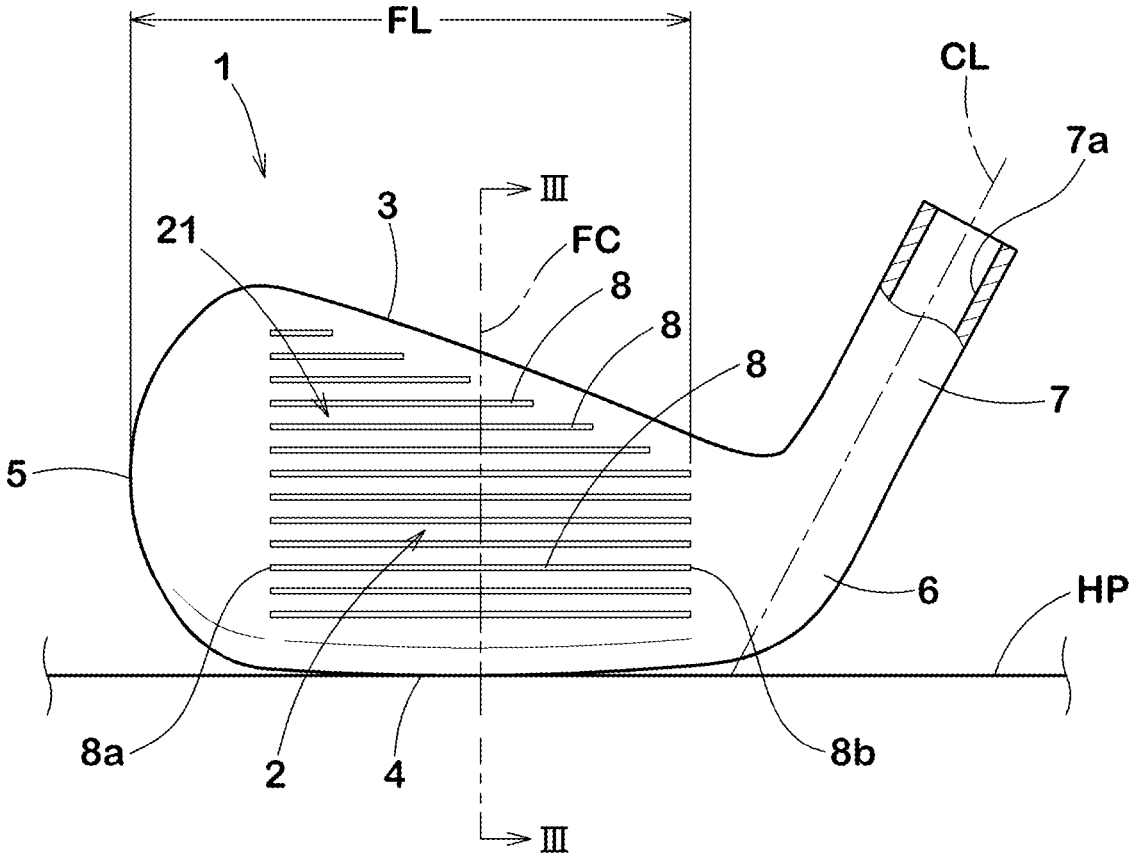
FIG. 1 is a front view of an iron-type golf club head as an embodiment of the present disclosure.

Embodiments of the present disclosure will now be described in detail in conjunction with accompanying drawings.

Throughout the description, the same or common elements of the heads are designated by the same reference numeral, and redundant explanations are omitted.

FIG. 1 to FIG. 4 are a front view, a rear view, a sectional view taken along line III-III of FIG. 1 and a perspective view, respectively, of an iron-type golf club head 1 as an embodiment of the present disclosure.

As shown in FIGS. 1-4, the head 1 comprises a face 2, a top 3, a sole 4, a toe 5, a heel 6 and a hosel 7.

In the present embodiment, the iron-type golf club head 1 is formed as a forged iron head made of a metal material. However, the head 1 may be formed as a cast iron, for example.

In the present embodiment, the head 1 has a one-piece structure. However, the head 1 may have a multi-piece structure.

The face 2 has a front surface defining a striking surface 21 for striking a ball. The striking surface 21 is provided with a plurality of face lines 8 for the purpose of increasing friction with the ball.

The face lines 8 are narrow grooves extending linearly in parallel to the toe-heel direction of the head 1. The face lines 8 are formed in a main striking area which is intended for the head 1. It should be noted that the face lines 8 are omitted in some drawings to simplify.

<Reference State>

In FIGS. 1 to 4, the head 1 is in its reference state.

Figure 5:
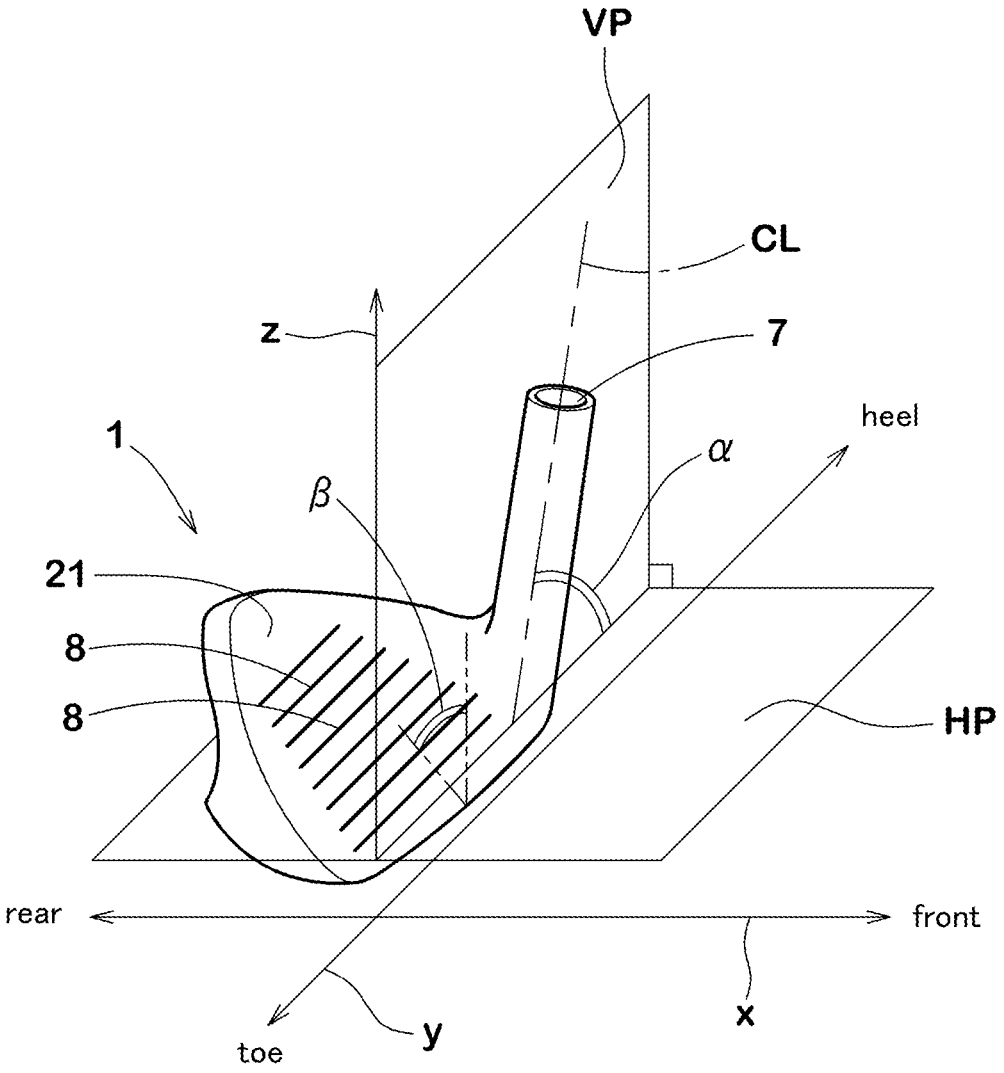
FIG. 5 is a perspective view of the iron-type golf club head for explaining a reference state of the golf club head.

The "reference state" means a state of the head 1 which is placed on a horizontal plane HP so that, as conceptually shown in FIG. 5, the face lines 8 formed in the striking surface 21 become parallel to the horizontal plane HP, and the central axis CL (axis of the club shaft) of the hosel 7 is arranged or laid in a reference vertical plane VP perpendicular to the horizontal plane HP.

In the reference state, the face lines 8 are parallel to both the horizontal plane HP and the reference vertical plane VP. In FIG. 5, "alpha" is a lie angle, and "beta" is a loft angle specified for the head.

In the present application including the description and claims, the configuration of each part or portion of the head is described assuming that the head 1 is placed in the reference state unless otherwise noted.

<Directions Related to Head>

As shown in FIG. 5, three orthogonal directions are defined as follows:

a front-back direction of the head is a direction parallel to the x-axis which is orthogonal to the reference vertical plane VP;

a toe-heel direction of the head is a direction parallel to the y-axis which is orthogonal to the front-back direction and parallel to the reference horizontal plane HP; and a top-bottom direction of the head 1 is a direction parallel to the z-axis which is orthogonal to both the x-axis and the y-axis.

Further, based on these directions, the following sides are defined:

a front side of the head 1 means the side of the striking surface 21 in the front-back direction;

a rear side or back side of the head 1 means the side of the back surface 22 in the front-back direction;

an upper side of the head 1 means the side of the top 3 in the top-bottom direction; and a lower side of the head 1 means the side of the sole 4 in the top-bottom direction.

<Structure of Each Part or Portion of Head>

Figure 3:
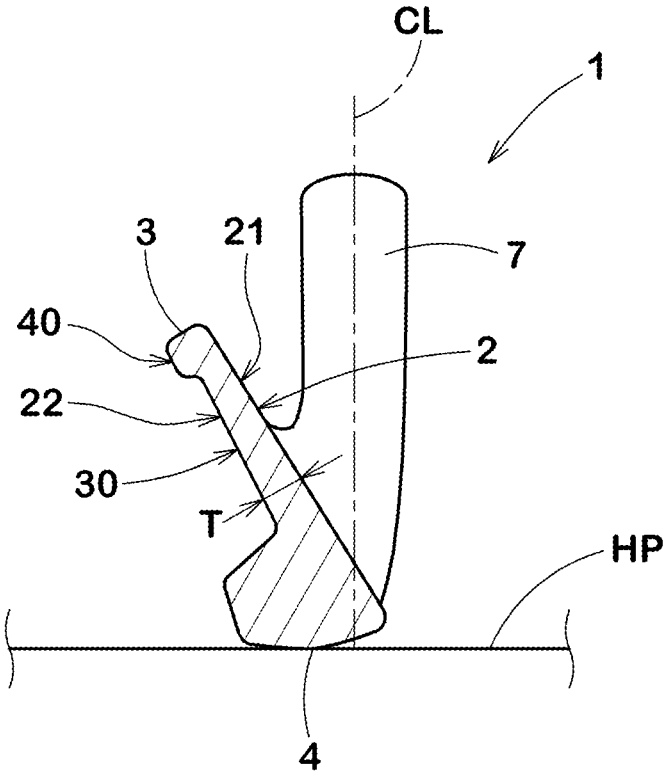
FIG. 3 is a sectional view taken along line of FIG. 1.
Figure 4:
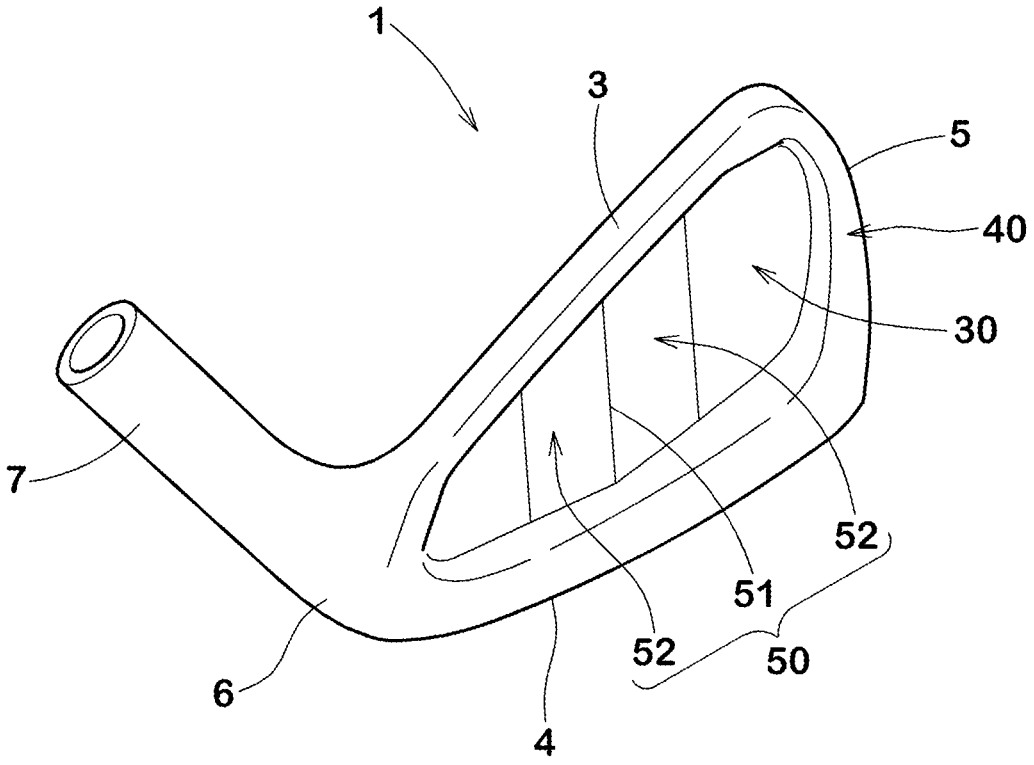
FIG. 4 is a perspective view of the iron-type golf club head shown in FIG. 1.

As shown in FIG. 3, the face 2 has the striking surface 21 and the back surface 22. The striking surface 21 in this embodiment is formed in a plane.

The thickness T of the face 2 (hereinafter, the face thickness T) is defined between the striking surface 21 and the back surface 22.

The face thickness T is measured perpendicularly to the striking surface 21 from the striking surface 21 to the back surface 22.

From the striking surface 21 to the back surface 22, the face 2 is formed as a continuous solid structure made of the metal material.

The top 3 extends rearward of the head 1 from the upper edge of the striking surface 21, for example, as shown in FIG. 3, and forms an upper surface of the head 1.

The sole 4 extends rearward of the head 1 from the lower edge of the striking surface 21, and forms a lower surface of the head 1.

The toe 5 is an end portion of the head farthest from the hosel 7 in the toe-heel direction, and smoothly connects between the top 3 and the sole 4.

The heel 6 is an end portion of the head which is located on the opposite side of the toe 5 in the toe-heel direction, and to which the hosel 7 is connected.

As shown in FIG. 1, the hosel 7 is provided with a shaft insertion hole 7*a* in which a club shaft (not shown) is fitted. The central axis CL of the hosel 7 is defined by the central axis of the shaft insertion hole 7*a*.

Figure 2:
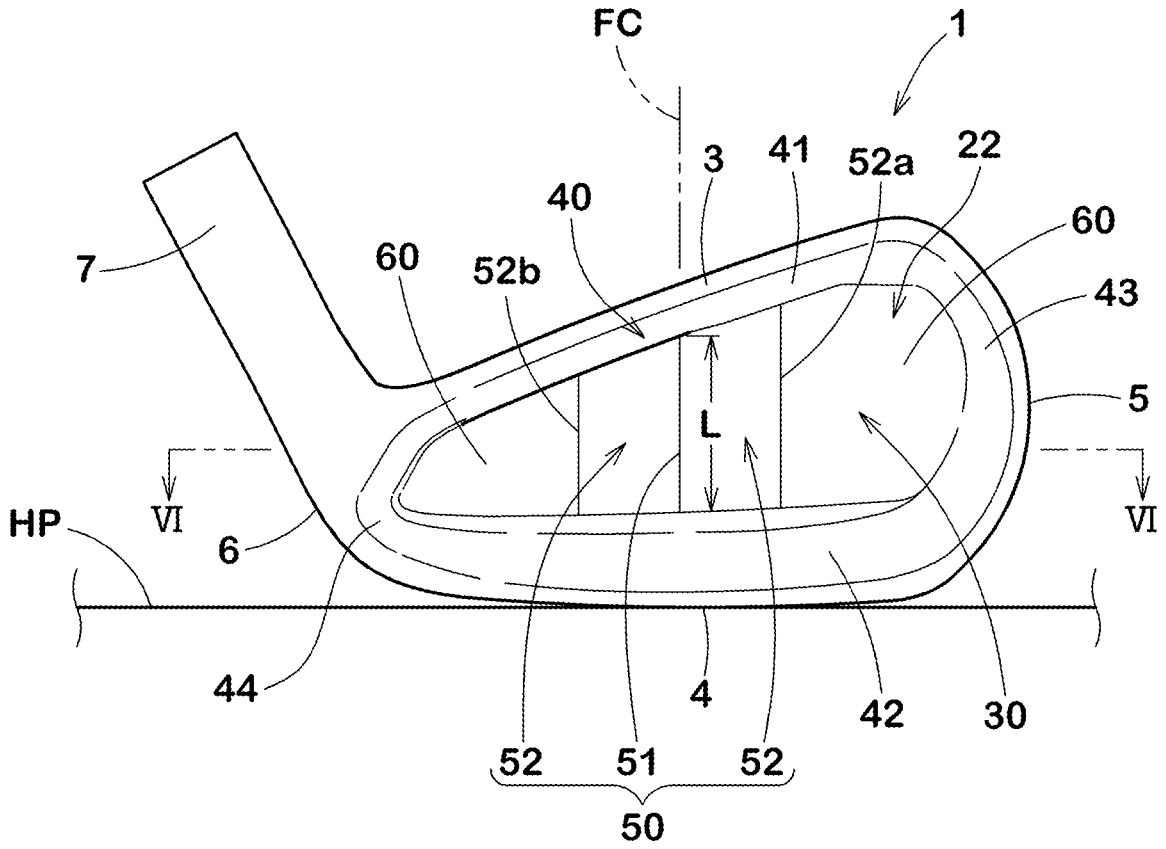
FIG. 2 is a rear view of the iron-type golf club head shown in FIG. 1.

In the present embodiment, as shown in FIGS. 2 and 3, the back surface 22 of the head 1 is provided with a cavity-forming portion 30 dented toward the striking surface 21, and there is formed a frame portion 40 extending in a peripheral portion of the back surface 22 so as to surround the cavity-forming portion 30.

The face thickness T of the portion of the face provided with the cavity-forming portion 30 is relatively small, and the face thickness T of the portion of the face provided with the frame portion 40 is relatively large.

The face thickness T of the portion of the face provided with the cavity-forming portion 30 can be set in a range from 1.0 to 4.0 mm, for example.

In the present embodiment, as shown in FIG. 2, the frame portion 40 includes a top side frame portion 41, a sole side frame portion 42, a toe side frame portion 43, and a heel side frame portion 44.

The top side frame portion 41 extends in the toe-heel direction along the top 3.

The sole side frame portion 42 extends in the toe-heel direction along the sole 4.

The toe side frame portion 43 and the heel side frame portion 44 are formed in the toe 5 and the heel 6, respectively, and connect between the top side frame portion 41 and the sole side frame portion 42 on the toe 5 side and the heel 6 side, respectively.

As described above, the frame portion 40 in the present embodiment is formed to extend continuously around the cavity-forming portion 30, namely, formed in an annular shape.

As another example of the frame portion 40, the frame portion may have a partially interrupted position.

In the cavity back iron-type golf club head 1 as in the present embodiment, a large amount of weight is distributed to the peripheral portion of the face 2, therefore, the moment of inertia around the center of gravity of the head becomes increased. As a result, the head 1 in the present embodiment can suppress an undesired rotational movement of the face 2 possible when the ball hits a position outside the sweet spot area of the striking surface 21. This helps to stabilize the directions of the hit balls.

In order to effectively derive such advantageous effect, the face thickness T measured in the frame portion 40 is preferably set in a range of not less than 5 mm, although the thickness is not particularly limited thereto.

<Protruding Portion>

Figure 6:
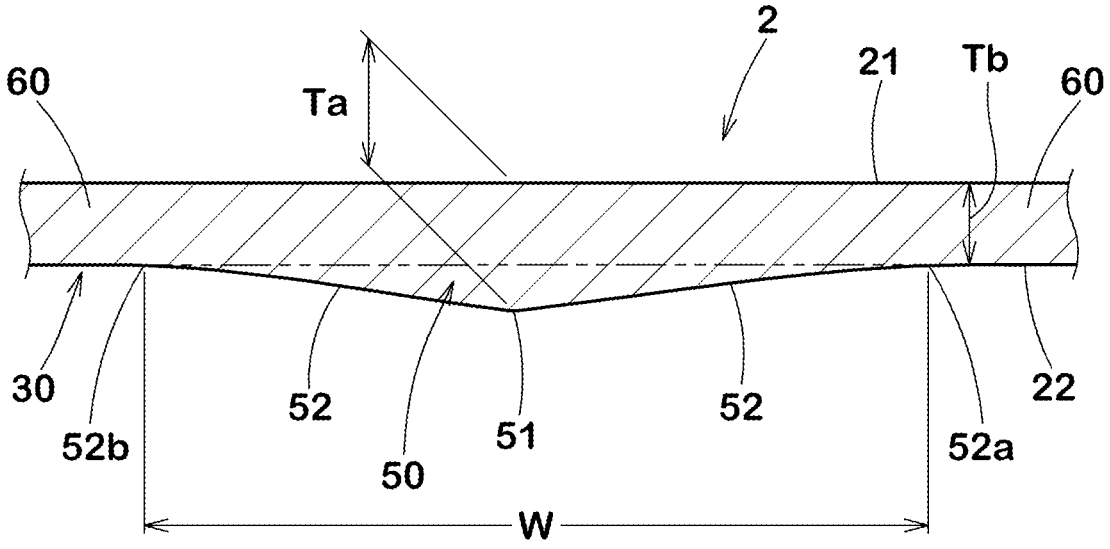
FIG. 6 is a sectional view taken along line VI-VI of FIG. 2.

FIG. 6 is a cross-sectional partial view of the face 2 taken along line VI-VI of FIG. 2. This cross section shown is in parallel to the toe-heel direction and orthogonal to the striking surface 21.

As shown in FIGS. 2 and 6, in the cavity-forming portion 30, there is formed a protuberance 50 in which the face thickness T is partially increased than other. The protuberance 50 extends in the top-bottom direction of the head within the cavity cavity-forming portion 30.

In the present embodiment, the protuberance 50 has a pair of inclined surfaces 52 and 52 and a ridge 51 therebetween. The ridge 51 is a part of the protuberance 50 protruding toward the rear of the head so that the face thickness T becomes largest in the protuberance 50.

One of the inclined surfaces 52 extends from the ridge 51 toward a toe side of the cavity-forming portion 30 while decreasing the face thickness.

The other of the inclined surfaces 52 extends from the ridge 51 toward a heel side of the cavity-forming portion 30 while decreasing the face thickness.

Thus, the face thickness T measured at the protuberance 50 becomes a maximum face thickness Ta at the ridge 51, and decreases from the ridge 51 to the toe side and the heel side.

In the present embodiment, the protuberance 50 extends in the top-bottom direction of the head, while having cross-sectional shapes similar to that shown in FIG. 6.

The protuberance 50 as described above provides the cavity-forming portion 30 with a locally increased face thickness, and improves the bending rigidity of the portion of the face provided with the cavity-forming portion 30 around an axis parallel to the toe-heel direction.

Therefore, in the head 1 of the present embodiment, a large deflection of the face 2 at the time of hitting the ball is suppressed, and as a result, the contact time between the ball and the striking surface 21 is shortened.

Therefore, the head 1 of the present embodiment can reduce the influence of a negative shear force on the ball at the time of hitting the ball, and can give a sufficient backspin to the launched ball.

Further, the protuberance 50 described above can improve the bending rigidity of the portion of the face provided with the cavity-forming portion 30 and provide a firm shot feeling with less vibration when hitting a ball.

Further, as the protuberance 50 is provided with the pair of inclined surfaces 52, the face thickness varies along the toe-heel direction from the ridge 51.

This can reduce the variation (change) in the shot feeling and the ball hit sound even when the ball hitting position on the striking surface 21 varies along the toe-heel direction, and can stably provide good hit feelings.

As shown in FIG. 2, the dimension L of the protuberance 50 measured in the top-bottom direction of the head is not less than 5 mm, preferably not less than 7 mm, more preferably not less than 10 mm although it is not particularly limited thereto.

This dimension L is that of the ridge 51 measured in the top-bottom direction of the head.

By setting the dimension L to be 5 mm or more, the bending rigidity of the portion of the face provided with the cavity-forming portion 30 is more reliably increased, and it becomes possible to give more backspin to the ball.

In the present embodiment, the protuberance 50 has a triangular cross section as shown in FIG. 6. Thus, the face thickness measured in the inclined surfaces 52 is continuously decreased to the toe side and the heel side. Therefore, the protuberance 50 of the present embodiment does not have a flat portion where a constant face thickness continues in the toe-heel direction.

In the embodiment as shown in FIG. 6, each inclined surface 52 may be a straight slope or a curved slope in a concave arc or convex arc in the cross section parallel to the toe-heel direction and orthogonal to the striking surface 21.

Figure 12A:
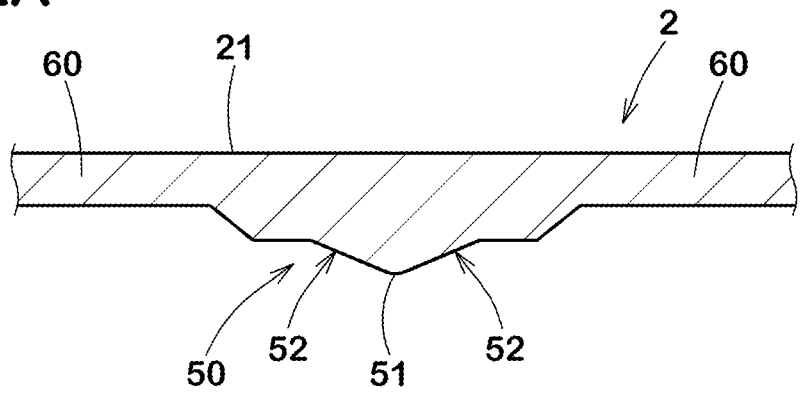
FIGS. 12A to 12D are cross-sectional views of the faces of golf club heads as further embodiments.

Further, the face thickness measured in the inclined surfaces 52 may be gradually decreased toward the toe side and the heel side in a stepwise manner as shown in FIG. 12A.

In this example, the inclined surface 52 partially includes a flat portion where a constant face thickness continuous in the toe-heel direction.

In the protuberance 50 in the present embodiment, the ridge 51 has a vertically extending ridge line (an angled corner) which is visible to the naked eye. However, the present disclosure is not limited to such example.

Figure 12B:
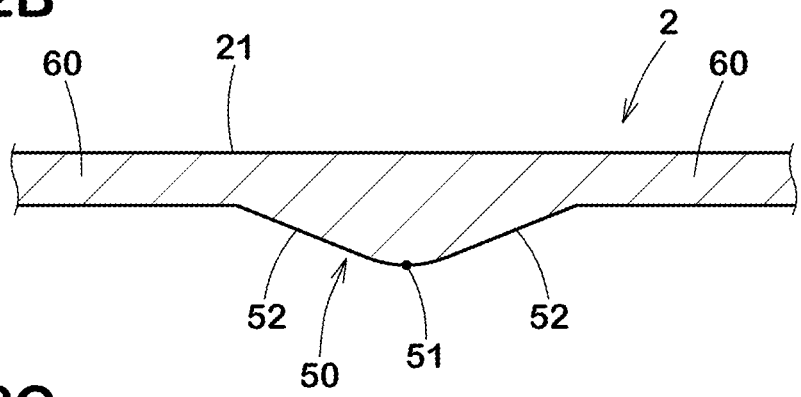

For example, as shown in FIG. 12B, the ridge 51 may be formed by a curved surface in an arc shape so as not to form a clear ridge line.

Figure 12C:
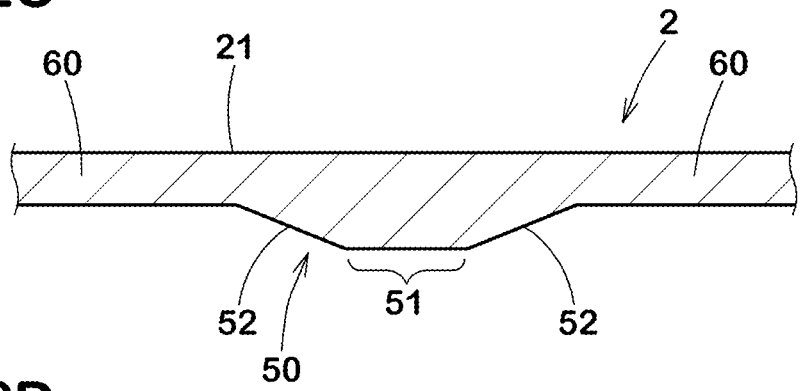
Figure 12D:
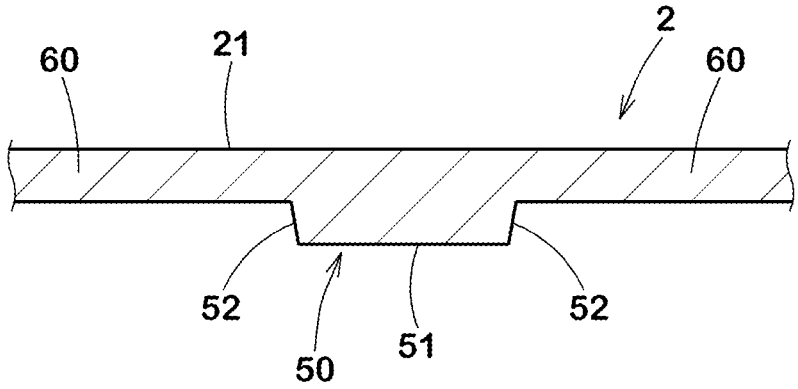

Further, as shown in FIG. 12C and FIG. 12D, the ridge 51 may be formed by a flat surface extending in the toe-heel direction where the face thickness is constant.

The position in the toe-heel direction of the ridge 51 is preferably located within a range of 5 mm, preferably 3 mm toward the toe and the heel from the center position FC (shown in FIGS. 1 and 2) in the toe-heel direction of the striking surface 21.

In particular, it is preferable that over the entire extent in the vertical direction of the ridge 51, the position of the ridge 51 is located within a range of 5 mm from the central position FC.

When the ridge 51 has a certain width in the toe-heel direction, the position of the ridge 51 is determined by the widthwise center position of the ridge 51.

In general, a golfer tends to try to hit the ball at the center position FC in the toe-heel direction of the striking surface 21.

Therefore, by setting the position of the ridge 51 within the above range, the above-mentioned function to give a sufficient backspin to the hit ball can be more reliably exerted. In addition, the function to give a firmer shot feeling and less vibration to the golfer when the ball is hit, can be more reliably exerted.

In the present application, the center position FC in the toe-heel direction of the striking surface 21 is defined as the center position in the toe-heel direction between the position in the toe-heel direction of the extreme end or ends 8*a* of the face lines 8 located on the most toe side, and the position in the toe-heel direction of the extreme end or ends 8*b* of the face lines 8 located on the most heel side, when the face lines 8 are formed as shown in FIG. 1.

Figure 7:
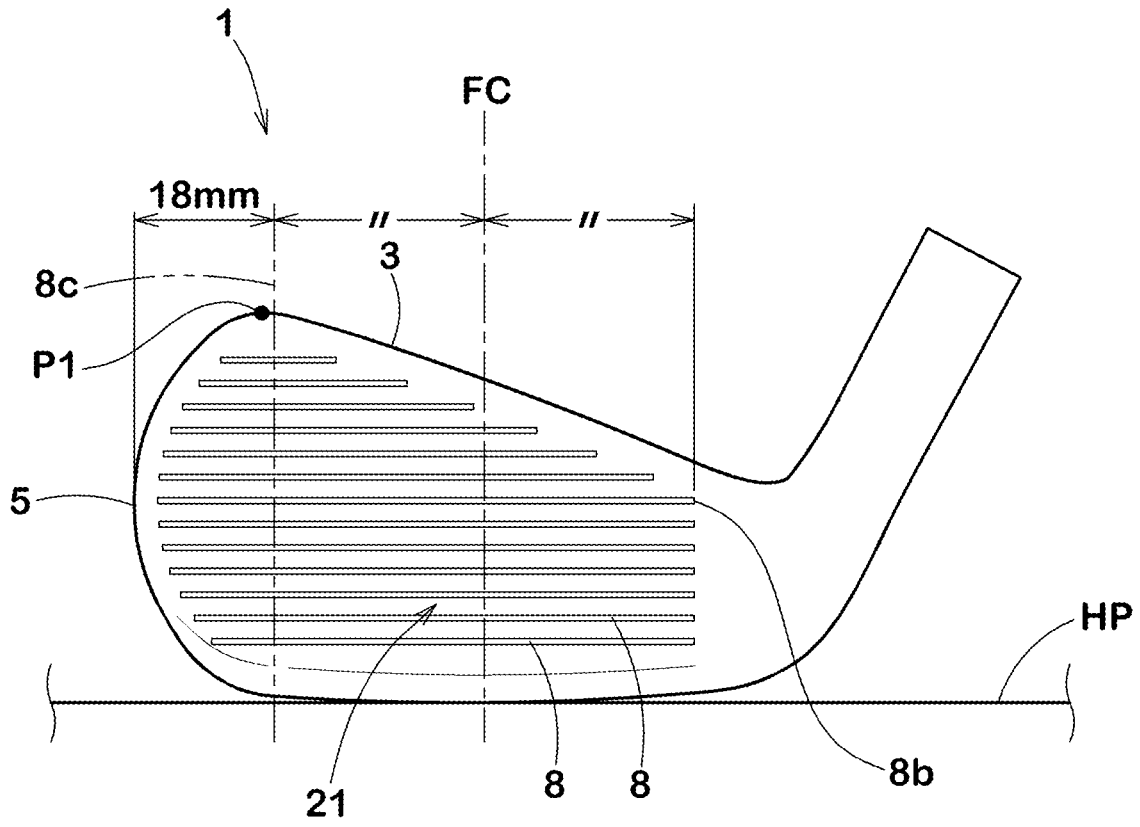
FIG. 7 is a front view of a golf club head as another embodiment.

However, as shown in FIG. 7, when the face lines 8 are formed such that at least some of them extend beyond the position in the toe-heel direction of the highest point P1 of the top 3 toward the toe 5, the central position FC is defined as the center position in the toe-heel direction between
a position 8*c* at 18 mm toward the heel from the toe-side extreme end of the striking surface 21, and
the above-mentioned position in the toe-heel direction of the extreme end or ends 8*b* of the face lines 8 located on the most heel side.

It is preferable that the protuberance 50 is connected to the top side frame portion 41 as shown in FIG. 2. In this case, an upper portion of the back surface 22 of the face 2 is provided with a T-shaped reinforcing structure formed by the top side frame portion 41 and the protuberance 50 intersecting therewith. Such T-shaped reinforcing structure can more effectively suppress the bending of the face 2 when the ball hits the upper portion of the striking surface 21, and thus can give more backspin to the ball.

Further, the protuberance 50 may be connected to the sole side frame portion 42. In this case, a lower portion of the back surface 22 of the face 2 is provided with an inverted T-shaped reinforcing structure formed by the sole side frame portion 42 and the protuberance 50 intersecting therewith. Such inverted T-shaped reinforcing structure can more effectively suppress the bending of the face 2 when the ball hits the lower portion of the striking surface 21, and thus can give more backspin to the ball.

Since the iron-type golf club head 1 has many opportunities to hit the ball at the sole side portion of the striking surface 21, such inverted T-shaped reinforcing structure is particularly preferable in that good hit feelings can be stably exhibited.

As shown in FIG. 6, the above-mentioned maximum face thickness Ta at the protuberance 50 is set to be not less than 4 mm, preferably not less than 4.5 mm, more preferably not less than 5 mm.

When the thickness of the protuberance 50 is 4.0 mm or more, the bending rigidity of the portion of the face provided with the cavity-forming portion 30 is more reliably increased, and more backspin can be given to the ball.

If the maximum face thickness Ta at the protuberance 50 becomes excessively large, then there is a possibility that the weight of the head is significantly increased, or that the weight is concentrated near the center of gravity of the head and the moment of inertia is not increased.

From such viewpoints, the maximum face thickness Ta at the protuberance 50 is not more than 8 mm, preferably not more than 7 mm, more preferably not more than 6 mm.

The maximum face thicknesses Ta at the protuberance 50 in respective cross sections of the face 2 similar to that shown in FIG. 6 may be constant or may vary in the top-bottom direction of the head.

However, it is preferable that the maximum face thickness Ta at the protuberance 50 continuously increases toward the sole 4. In this case, it is possible to stably exert good hit feelings as well as distribute more weight to the sole side of the head 1 to lower the position of the center of gravity of the head 1.

As shown in FIG. 2, the portion of the face provided with the cavity-forming portion 30 may include a thin portion 60 where the face thickness is not more than 3 mm on the toe side and/or the heel side of the protuberance 50. By providing the thin portion 60 on the toe side and/or the heel side of the protuberance 50, the effect of distributing the weight to the periphery of the face by the cavity back can be sufficiently maintained.

In the head 1 of the present embodiment, the thin portion 60 having a constant thickness Tb is formed on both the toe side and the heel side of the protuberance 50.

As another example, the thin portion 60 may be formed on only one of the toe side and the heel side of the protuberance 50.

As shown in FIG. 1 and FIG. 6, a width W in the toe-heel direction of the protuberance 50 is not less than 10%, preferably not less than 15%, more preferably not less than 20% of a length FL in the toe-heel direction of the face 2. The width W is the distance in the toe-heel direction between the toe-side end 52*a* and the heel-side end 52*b* of the respective inclined surfaces 52.

When the width W of the protuberance 50 is 10% or more of the face length FL, it is preferable in that the change in the face thickness becomes more gradual, and thereby, it is possible to further suppress the variation in the shot feeling when the hitting position varies.

On the other hand, if the width W of the protuberance 50 becomes excessively large, then there is a possibility that the weight of the head is significantly increased, or that the weight is concentrated near the center of gravity of the head, and as a result, the moment of inertia is not increased. From such viewpoints, the width W of the protuberance 50 is not more than 55%, preferably not more than 50%, more preferably not more than 45% of the face length FL.

In the present embodiment, as shown in FIG. 2, the width W of the protuberance 50 is substantially constant along the top-bottom direction of the head.

As another example, the width W of the protuberance 50 may vary in the top-bottom direction of the head.

Figure 8:
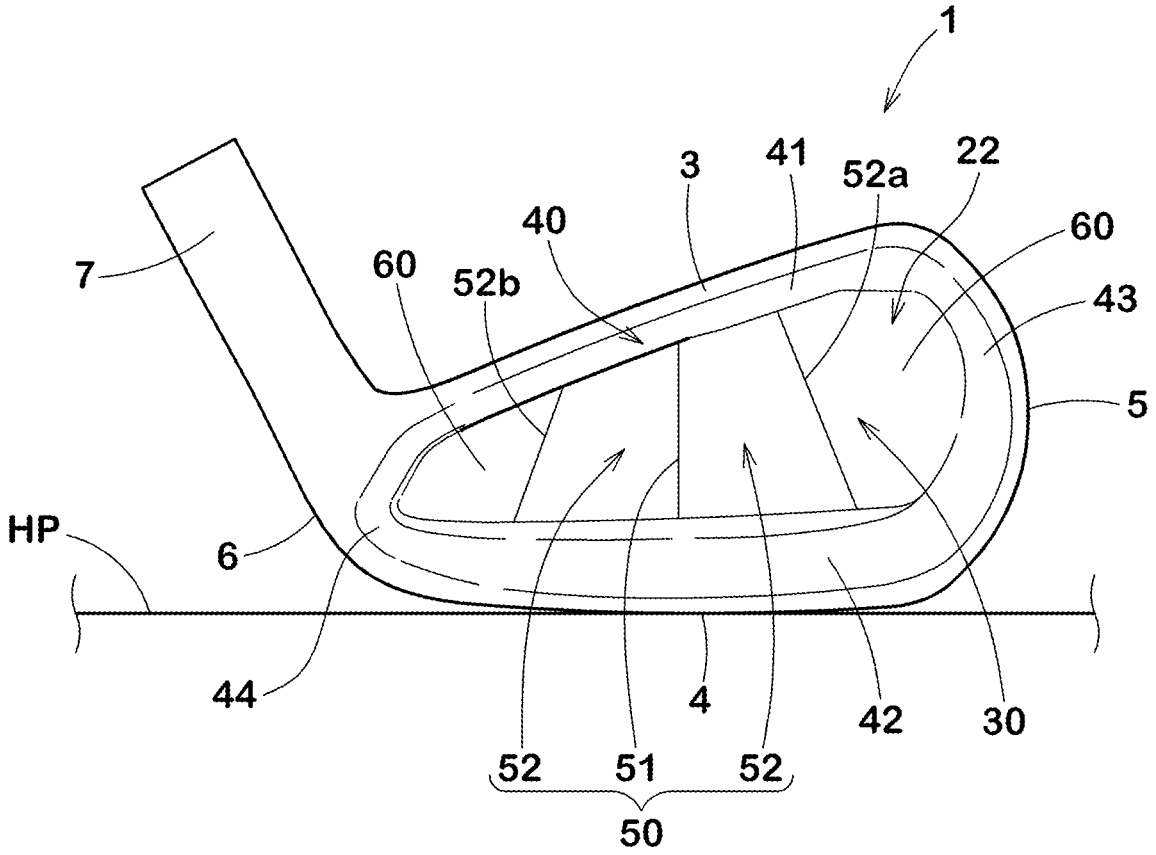
FIG. 8 is a rear view of a golf club head as another embodiment.

FIG. 8 shows such an example in which the width W of the protuberance 50 increases toward the sole 4. In this case, it is possible to distribute more weight to the sole side of the head 1, and it is possible to lower the position of the center of gravity of the head 1.

It is preferable that the width W of the protuberance 50 changes continuously. As a result, an effect of suppressing the variation in the shot feeling and the ball hit sound can be obtained even when the ball hitting positions of the striking surface 21 are varied in the top-bottom direction.

Figure 9:
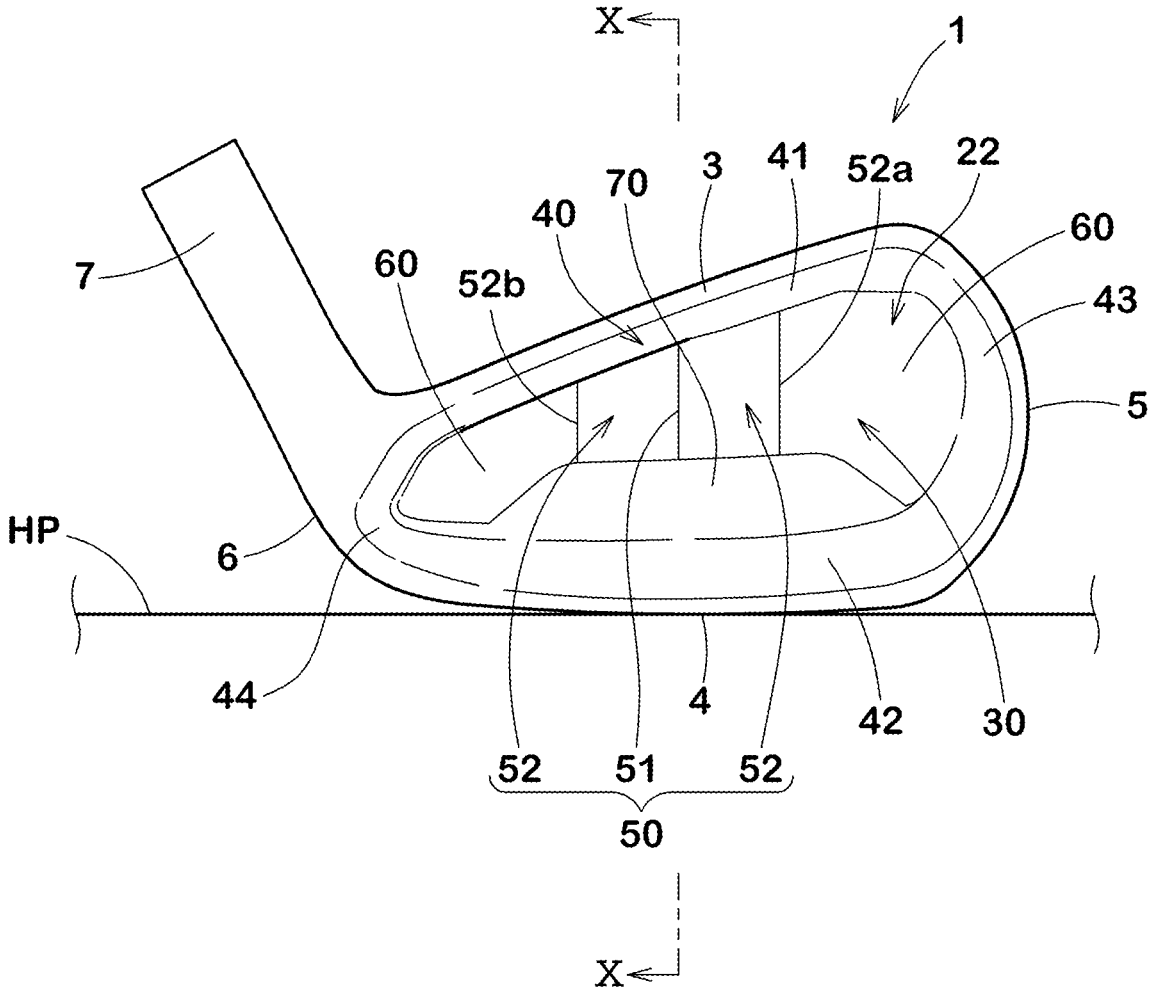
FIG. 9 is a rear view of a golf club head as another embodiment.
Figure 10:
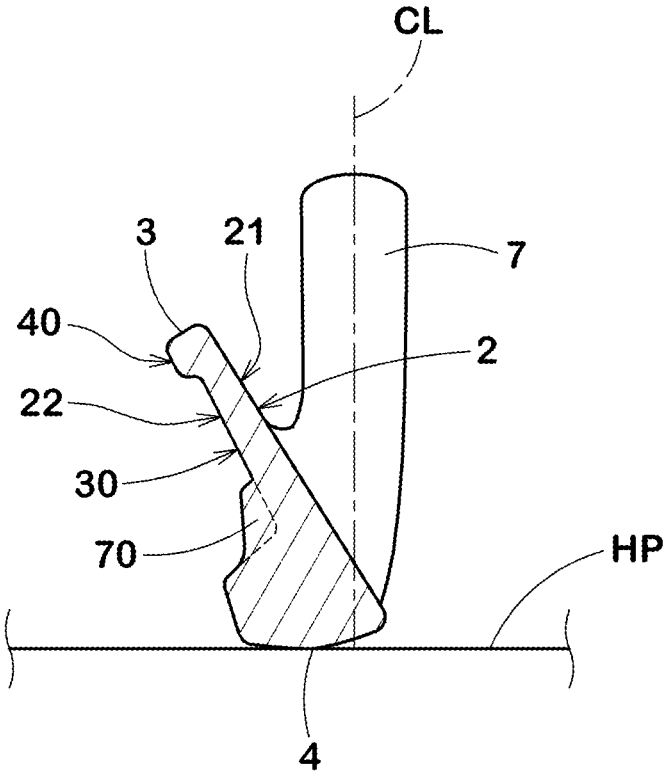
FIG. 10 is a cross-sectional view taken along line X-X of FIG. 9.
Figure 11:
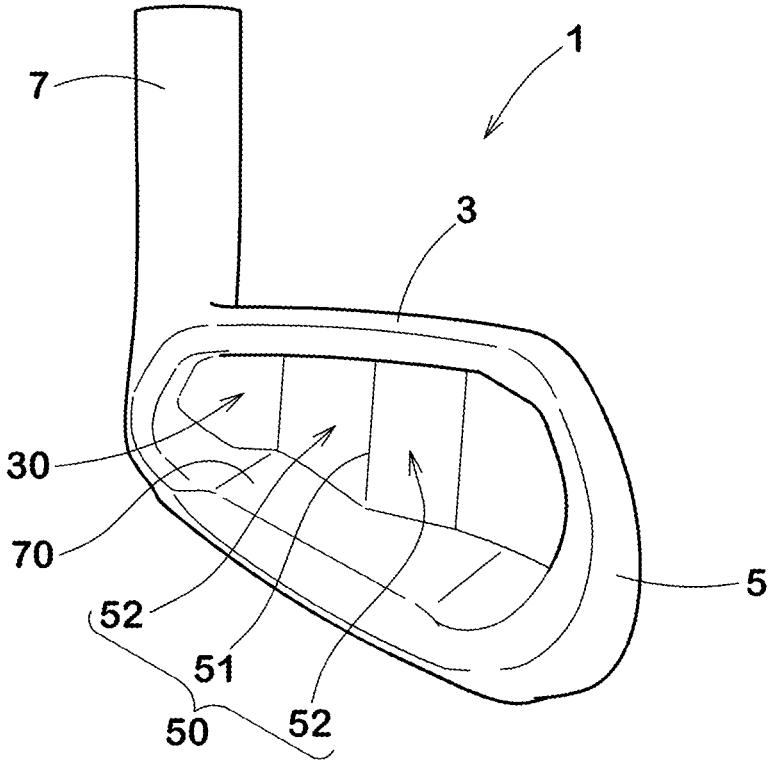
FIG. 11 is a perspective view of the golf club head shown in FIG. 9.

FIGS. 9 to 11 show a golf club head 1 as another embodiment of the present disclosure. FIG. 9 is a rear view thereof, FIG. 10 is a sectional view taken along line X-X of FIG. 9, and FIG. 11 is a perspective view thereof. As shown, the head 1 in this embodiment has the frame portion 40 of a different structure than the above-mentioned embodiment shown in FIGS. 1 to 4. In this embodiment, the frame portion 40 includes an expansion portion 70 extending toward the center of the face in the rear view (FIG. 9).

The expansion portion 70 in this embodiment is formed on the sole side frame portion 42. However, the expansion portion 70 may be provided on another portion.

The face thickness measured at the expansion portion 70 is larger than the face thickness measured at the protuberance 50.

In this embodiment, the width in the toe-heel direction of the expansion portion 70 is larger than the width in the toe-heel direction of the protuberance 50, and the expansion portion 70 extends toward the toe side and heel side than the protuberance 50.

The head 1 provided with such expansion portion 70 can be significantly increased in the bending rigidity in the lower portion of the striking surface 21 which has many chances of hitting the ball, and can be provided with the effect of increasing the backspin of the ball and a stable and good shot feeling.

In this embodiment, in the rear view of the head 1 in the reference state, the expansion portion 70 has a substantially trapezoidal shape such that the two legs are inclined to the protuberance 50, the top-side base is substantially parallel to the toe-heel direction, and the sole side base is merged into the sole side frame portion 42. Thus, the width in the toe-heel direction of the expansion portion 70 is gradually increased toward the top 3. Whereas the protuberance 50 in this embodiment has a substantially constant toe-heel-direction width from the expansion portion 70 to the top side frame portion 41.

Figure 13:
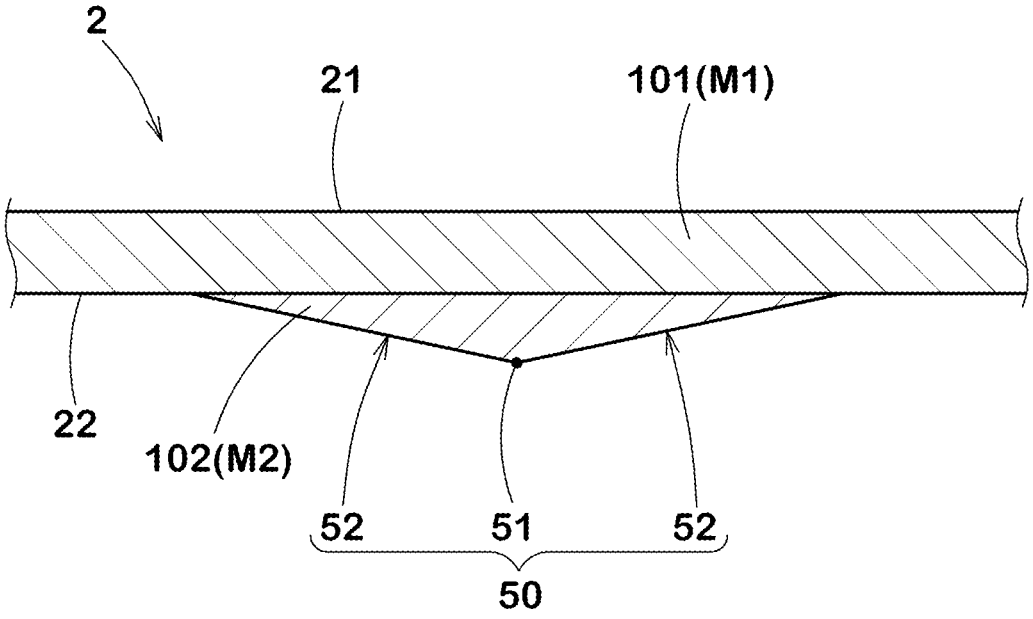
FIG. 13 is a cross-sectional view of the face of a golf club head as another embodiment.
Figure 14:
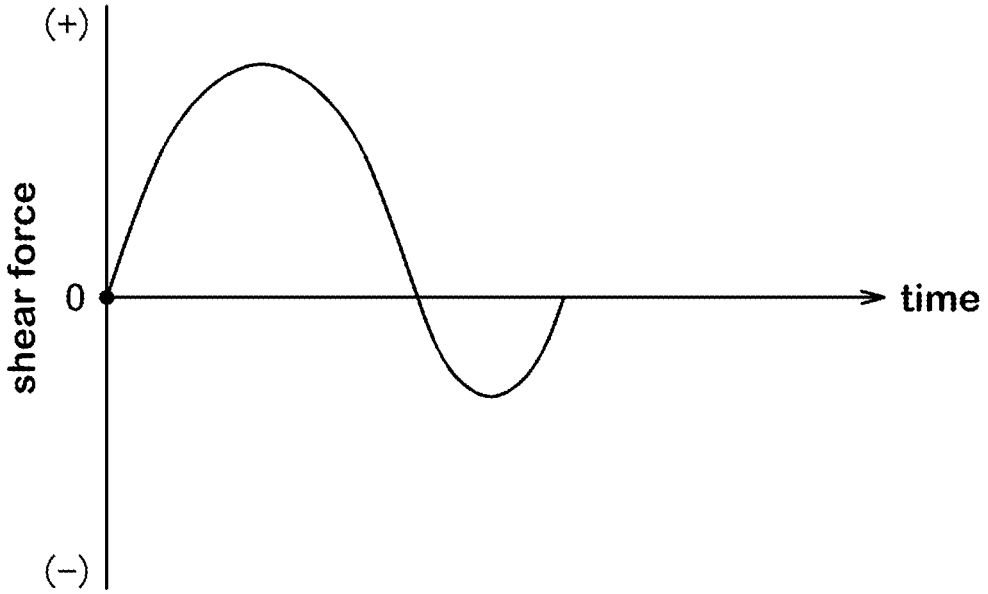
FIG. 14 is a graph showing the relationship between the shear force acting on the hit ball and the elapsed time.

FIG. 13 shows a cross-sectional view of the face 2 as still another example. This cross section corresponds to the cross section of FIG. 6. As shown in FIG. 13, the face 2 is composed of a first part 101 made of a first material M1 and forming the striking surface 21, and a second part 102 made of a second material M2 and forming the protuberance 50.

In this example, the first part 101 is formed in the form of a plate having a substantially constant thickness.

The second part 102 is formed to have a triangular cross section and fixed to the rear surface of the first part 101. The second material M2 has a higher elastic modulus than the first material M1. In this case, there is an advantage such that the bending rigidity of the face 2 can be effectively increased by the protuberance 50 even having a smaller volume as compared with the face 2 formed from a single material.

While detailed description has been made of preferable embodiments of the present disclosure, the present disclosure can be embodied in various forms without being limited to the illustrated embodiments.

Comparison Tests

Based on the structure shown in FIGS. 1 to 4, golf club heads were experimentally manufactured, and the heads were attached to identical golf shafts to form golf clubs. The specifications are listed in Table 1.

Then, each golf club was tested for the amount of backspin and launch speed of the hit ball, and the shot feeling and the ball hit sound.

The test methods are as follows.

<Amount of Backspin and Launch Speed of Ball>

Each golf club was attached to a swing robot, and hit balls ten times at the same head speed. And the backspin and launch speed of the ball were measured at each time. Then the average of the ten measured values of the backspin and the average of the ten measured values of the launch speed were obtained. The results are indicated in Table 1 by an index based on the comparative example being 100, wherein the larger value is better.

<Shot Feeling and Hit Sound>

This test was conducted with the participation of twenty advanced golfers as testers. Each tester hit balls five times per each golf club, and the shot feeling and hit sound were sensory evaluated into five ranks, wherein the higher rank number is better. The average value of the rank numbers evaluated by the twenty testers is indicated in Table 1.

TABLE 1

| head | comparative example | working example 1 | working example 2 | working example 3 | working example 4 | working example 5 |
|---|---|---|---|---|---|---|
| basic head structure | FIG. 2 | FIG. 2 | FIG. 2 | FIG. 2 | FIG. 8 | FIG. 9 |
| presence or absence of protuberance | absence | presence | presence | presence | presence | presence |
| maximum face thickness Ta at protuberance (mm) | 3.0 constant | 4.0 | 4.5 | 5.0 | 5.0 | 5.0 |
| face thickness Tb in cavity-forming portion other than protuberance (mm) | | 3.0 | 3.0 | 3.0 | 3.0 | 3.0 |
| dimension L (mm) | — | 23.0 | 23.0 | 23.0 | 23.0 | 15.0 |
| width W/face length FL (%) | — | 35 | 35 | 35 | 35-41 | 35 |
| backspin amount | 100 | 101 | 102 | 103 | 104 | 105 |
| launch speed | 100 | 100 | 100 | 100 | 100 | 100 |
| shot feeling | 100 | 105 | 110 | 115 | 120 | 125 |
| ball hit sound | 100 | 105 | 110 | 115 | 120 | 125 |

From the test results, it was confirmed that the working examples gave more backspin to the hit balls without impairing the ball hit sound and the shot feeling as compared with the comparative example.

Statement of the Present Disclosure

The present disclosure is as follows.

Disclosure 1: An iron-type golf club head comprising: a face having a striking surface and a back surface opposite to the striking surface, and having a face thickness defined between the striking surface and the back surface, wherein the back surface is provided with a cavity-forming portion dented toward the striking surface, the cavity-forming portion is provided with a protuberance in which the face thickness is partially increased, the protuberance extends in a top-bottom direction of the head, and the protuberance has a ridge and a pair of inclined surfaces, wherein, in a cross section of the face orthogonal to the striking surface and parallel to a toe-heel direction of the head, the face thickness measured at the ridge is largest in the protuberance, one of the inclined surfaces extends toward a toe of the head from the ridge while decreasing the face thickness, and the other of the inclined surfaces extends toward a heel of the head from the ridge while decreasing the face thickness.

Disclosure 2: The golf club head according to Disclosure 1, wherein a position in the toe-heel direction of the ridge is located within a range of 5 mm toward the toe and 5 mm toward the heel from a center position in the toe-heel direction of the striking surface.

Disclosure 3: The golf club head according to Disclosure 1 or 2, wherein the back surface is provided with a frame portion surrounding the cavity-forming portion, the frame portion includes a top side frame portion, and the protuberance is connected to the top side frame portion.

Disclosure 4: The golf club head according to Disclosure 1, 2 or 3, wherein the back surface is provided with a frame portion surrounding the cavity-forming portion, the frame portion includes a sole side frame portion, and the protuberance is connected to the sole side frame portion.

Disclosure 5: The golf club head according to any one of Disclosures 1 to 4, wherein the face thickness measured at the protuberance is 4 mm or more.

Disclosure 6: The golf club head according to any one of Disclosures 1 to 5, wherein the portion of the face provided with the cavity-forming portion includes a thin portion in which the face thickness is not more than 3 mm, on one of or each of the toe side and the heel side of the protuberance.

Disclosure 7: The golf club head according to any one of Disclosures 1 to 6, wherein the dimension in the top-bottom direction, of the protuberance is not less than 5 mm.

Disclosure 8: The golf Club head according to any one of Disclosures 1 to 7, wherein the width W in the toe-heel direction of the protuberance is not less than 10% of a length in the toe-heel direction of the face.

Disclosure 9: The golf club head according to any one of Disclosures 1 to 7, wherein the width W in the toe-heel direction of the protuberance is not less than 15% of the length in the toe-heel direction of the face.

Disclosure 10: The golf club head according to any one of Disclosures 1 to 9, wherein the width in the toe-heel direction of the protuberance is constant along the top-bottom direction of the head.

Disclosure 11: The golf club head according to any one of Disclosures 1 to 9, wherein the width in the toe-heel direction of the protuberance varies along the top-bottom direction of the head.

Disclosure 12: The golf club head according to Disclosure 11, wherein the width in the toe-heel direction of the protuberance increases toward a sole of the head.

Disclosure 13: The golf club head according to any one of Disclosures 1 to 12, wherein the face comprises a first part made of a first material and forming the striking surface, and a second part made of a second material and forming the protuberance, and the second material has a higher elastic modulus than the first material.

Disclosure 14: The golf club head according to any one of Disclosures 1 to 13, wherein in the portions of the face respectively provided with the inclined surfaces, the face thickness is continuously decreased toward the toe and the heel, respectively.

Disclosure 15: The golf club head according to any one of Disclosures 1 to 13, wherein, in the portions of the face respectively provided with the inclined surfaces, the face thickness is decreased in a stepwise manner toward the toe and the heel, respectively.

Disclosure 16: The golf club head according to Disclosure 1, wherein the back surface is provided with a frame portion surrounding the cavity cavity-forming portion, the frame portion includes a sole side frame portion, and an expansion portion extending toward the center of the face from the sole side frame portion, and the face thickness measured at the expansion portion is larger than the face thickness measured at the protuberance.

Disclosure 17: The golf club head according to Disclosure 16, wherein the width in the toe-heel direction of the expansion portion is larger than the width in the toe-heel direction of the protuberance, and the expansion portion extends toward the toe side and heel side than the protuberance.

DESCRIPTION OF THE REFERENCE SIGNS

1 head
2 face
3 top
4 sole
5 toe
6 heel
21 striking face
22 back surface
30 cavity-forming portion
40 frame portion
41 top side frame portion
42 sole side frame portion
50 protuberance
51 ridge
52 inclined surface
60 thin portion
101 first part
102 second part

The invention claimed is:

1. An iron-type golf club head comprising:

a face having a striking surface and a back surface opposite to the striking surface, and having a face thickness defined between the striking surface and the back surface, wherein the back surface is provided with a cavity-forming portion dented toward the striking surface, the cavity-forming portion is provided with a protuberance in which the face thickness is partially increased, the protuberance extends in a top-bottom direction of the head, and the protuberance has a ridge and a pair of inclined surfaces, wherein, in a cross section of the face orthogonal to the striking surface and parallel to a toe-heel direction of the head, the face thickness measured at the ridge is largest in the protuberance, one of the inclined surfaces extends toward a toe of the head from the ridge while decreasing the face thickness, and the other of the inclined surfaces extends toward a heel of the head from the ridge while decreasing the face thickness, wherein the back surface is provided with a frame portion surrounding the cavity-forming portion, the frame portion includes a top side frame portion, a sole side frame portion, and an expansion portion extending toward a center of the face from the sole side frame portion, the face thickness measured at the expansion portion is larger than the face thickness measured at the protuberance, the protuberance has a top-side end connected to the top side frame portion and a sole-side end connected to the expansion portion, the protuberance has a toe-side edge and a heel-side edge, and has a width measured in the head toe-heel direction from the heel-side edge to the toe-side edge, the expansion portion has a width in the head toe-heel direction which is larger than the width of the protuberance, and the expansion portion extends further towards the toe than the toe-side edge of the protuberance and further towards the heel than the heel-side edge of the protuberance, and the one of the inclined surfaces and the other of the inclined surfaces intersect so as to form a single ridge line defining the ridge, and the ridge line extends from the top side frame portion to the expansion portion.

2. The golf club head according to claim 1, wherein a position in the head toe-heel direction of the ridge is located within a range of 5 mm toward the toe and 5 mm toward the heel from a center position in the head toe-heel direction of the striking surface.

3. The golf club head according to claim 1, wherein the face thickness measured at the ridge of the protuberance is 4 mm or more.

4. The golf club head according to claim 1, wherein the portion of the face provided with the cavity-forming portion includes a thin portion in which the face thickness is not more than 3 mm, on one of or each of the toe side and the heel side of the protuberance.

5. The golf club head according to claim 1, wherein a dimension in the head top-bottom direction of the protuberance is not less than 5 mm.

6. The golf Club head according to claim 1, wherein a width W in the head toe-heel direction of the protuberance is not less than 10% of a length in the head toe-heel direction of the face.

7. The golf club head according to claim 6, wherein the width W in the head toe-heel direction of the protuberance is not less than 15% of the length in the head toe-heel direction of the face.

8. The golf club head according to claim 1, wherein a width in the head toe-heel direction of the protuberance is constant along the top-bottom direction of the head.

9. The golf club head according to claim 1, wherein a width in the head toe-heel direction of the protuberance varies along the top-bottom direction of the head.

10. The golf club head according to claim 9, wherein a width in the head toe-heel direction of the protuberance increases toward a sole of the head.

11. The golf club head according to claim 1, wherein the face comprises a first part made of a first material and forming the striking surface, and a second part made of a second material and forming the protuberance, and the second material has a higher elastic modulus than the first material.

12. The golf club head according to claim 1, wherein in portions of the face respectively provided with the inclined surfaces, the face thickness is continuously decreased toward the toe and the heel, respectively.

13. The golf club head according to claim 1, wherein in portions of the face respectively provided with the inclined surfaces, the face thickness is decreased in a stepwise manner toward the toe and the heel, respectively.

* * * * *